US005762217A

United States Patent [19]

Ohmi et al.

[11] Patent Number: 5,762,217

[45] Date of Patent: Jun. 9, 1998

[54] RESIN CAP

[75] Inventors: Hidehiko Ohmi; Tateo Kubo; Mitsuo Kumata, all of Hiratsuka, Japan

[73] Assignee: Japan Crown Cork Co., Ltd., Japan

[21] Appl. No.: 607,059

[22] Filed: Feb. 26, 1996

[30] Foreign Application Priority Data

Mar. 3, 1995 [JP] Japan ..... 7-044431
Feb. 19, 1996 [JP] Japan ..... 8-030929

[51] Int. Cl.[6] ..... B65D 41/48

[52] U.S. Cl. ..... 215/253; 215/274; 215/305; 215/320

[58] Field of Search ..... 215/253, 254, 215/256, 274, 305, 320; 220/269, 276, 782, 784, 786, 318, 319

[56] References Cited

U.S. PATENT DOCUMENTS

| | | | |
|---|---|---|---|
| 3,462,035 | 8/1969 | Grussen | 215/253 |
| 3,589,543 | 6/1971 | Weigand | 215/253 X |
| 3,858,742 | 1/1975 | Grussen | 215/253 |
| 3,986,627 | 10/1976 | Zapp | 215/237 |
| 3,990,598 | 11/1976 | Zapp et al. | 215/272 |
| 4,216,872 | 8/1980 | Bean | 215/253 |
| 4,230,229 | 10/1980 | Crisci | 215/253 |
| 4,279,353 | 7/1981 | Honma | 215/254 |
| 4,534,481 | 8/1985 | Summers et al. | 215/253 |

FOREIGN PATENT DOCUMENTS

| | | |
|---|---|---|
| A-1197164 | 5/1958 | France . |
| A-2141585 | 6/1991 | France . |
| A-3017839 | 5/1980 | Germany . |
| U-8801621 | 5/1988 | Germany . |
| A-430479 | 2/1967 | Switzerland . |
| A-2085854 | 9/1981 | United Kingdom . |
| A-2086361 | 9/1981 | United Kingdom . |

*Primary Examiner*—Stephen Cronin

[57] ABSTRACT

The resin cap of this invention comprises a cap proper provided with a skirt portion and a continuous ring member provided so as to cover the outer surface of the skirt portion of the cap proper. A plurality of axially extending cuts are circumferentially spaced in the skirt portion of the cap proper, and the skirt portion of the cap proper and the ring-like member are separated via a cutting surface, but are integrally formed via a plurality of frangible bridge portions or connecting portions upwardly or downwardly of the cutting surface. The outer surface of the skirt portion of the cap proper and the inner surface of the ring-like member are intimately adhered at a portion of the cutting surface. This cap can form a sealing structure having sealing reliability, and can be opened without using any particular tool. Furthermore, it has excellent tamper-evident characteristics.

15 Claims, 10 Drawing Sheets

RESIN CAP

BACKGROUND OF THE INVENTION

1. [Field of the Invention]

The present invention relates to a resin cap having excellent sealing reliability and can openability, and more specifically, to a resin cap which can form reliable sealing and can be easily and exactly opened and has tamper-evident (TE) characteristics.

2. [Description of the Prior Art]

Since a resin cap can be integrally molded, and has excellent moldability and flexibility, it can be fixed to a mouth portion of a container by a stopping operation and has been used heretofore in various forms.

Various resin caps which have excellent sealability, can be easily removed from the mouth portion of the container without using tools, and have excellent openability have been proposed. For example, Japanese Patent Publication No. 10555/1976 describes an unfair act-preventing closure composed of a synthetic resin having a handle on the outer surface of a skirt wall. The handle of this closure is spaced from an outer circumferential surface of the skirt wall and surrounding it. It is not a complete ring but arcuate and its both end portions are firmly fixed to the outer surface of the skirt wall. The inner surface of the handle is connected to the outer surface of the skirt wall by a plurality of easily breakable connecting pieces formed circumferentially at suitable distances. Accordingly, when the handle of the closure mounted on the container is pulled up by hand, the above connecting pieces are broken off and this handle is connected to the skirt wall only at both end portions. By further pulling the handle upwardly, the skirt wall is turned up from a portion where the handle is not formed (between both end portions of the handle), and the closure is removed from the container.

The prior art is significant because it provides a plastic cap which can be opened by hand without requiring any particular tool such as a cap opener and to which an unfair act-preventing function is imparted. However, there is a problem in respect of a sealing reliability. Circumferential protrusions are formed on the inner surface of the skirt wall, and when these protrusions are sealed with the neck portion of the container, the container is sealed. In the above closure, it is impossible to provide the protrusions over the entire circumference of the inner surface of the skirt wall. In order to open the cap by hand, it is impossible to form the protrusion in a portion where the handle is not formed. When the protrusions are formed in this portion, the skirt wall cannot easily be turned up, and the openability of the can becomes unsatisfactory. Since the protrusions for securing sealability are not formed over the entire circumference of the inner surface of the skirt wall, the closure of the above prior art has unsatisfactory sealing reliability.

SUMMARY OF THE INVENTION

Accordingly, it is an object of this invention to provide a resin cap which forms a sealing structure having sealing reliability by a stopping operation, and can be easily opened without using any particular tool and has tamper-evident characteristics.

Another object of the invention is to provide a resin cap in which in a stopping action, a ring-like member protects a skirt portion of a cap proper, in a closure-closed condition, the ring member adheres intimately to the outer surface of the skirt portion of the cap proper to maintain sealability, the ring-like member is removed at the time of opening the cap, the skirt portion can be easily removed from the mouth portion of the container, and in addition, the ring-like member has tamper-evident characteristics.

According to the present invention, there is provided a cap made from resin which comprises a cap proper comprising a top panel and a skirt having a protrusion engaging with a mouth of a vessel at an interface thereof, and a ring member formed integrally with the cap proper so as to cover an outer surface of the skirt, wherein a plurality of slits elongating in an axial direction are provided in the skirt at an interval into a circumferential direction, the skirt and the ring member are separated by cutting faces but interconnected with a plurality of frangible bridges, if necessary, and with a hinge, and an outer surface of the skirt and an inner surface of the ring member are closely contacted with each other at the cutting portion.

In the present invention, an opening tab is preferably formed in a part of the ring-like member.

The skirt portion of the cap proper and the ring member are preferably formed by injection- or compression molding them integrally, thereafter making a cut by a cutter between the two to separate a portion excluding a bridge portion or further a connecting portion.

The cap of the present invention is composed of a skirt portion in the cap proper and a ring member provided so as to cover the outer surface of the skirt portion, the skirt portion of the cap proper is provided with a plurality of slits extending in an axial direction at intervals in a circumferential direction, the skirt portion of the cap proper is separated from the ring member via a cutting face, the skirt portion and the ring member are integrally formed via a plurality of frangible bridges or further connecting portions on the upper side or under side of the cutting faces, and the outside surface of the skirt portion of the cap proper and the inner surface of the ring member are intimately adhered at a portion of the cutting faces.

The skirt portion of the cap proper is provided with a plurality of slits extending in an axial direction at intervals in a circumferential direction whereby the skirt portion is broadened diametrically outwardly at the time of cap opening so that the cap proper can be easily removed from the mouth portion of the container.

In the present invention, the skirt portion of the cap proper is separated from the ring member via a cutting face, but they are integrally molded through a plurality of frangible bridges or further connecting portions on the upper side or the lower side from the cutting face and the outer surface of the skirt portion of the cap proper and the inner surface of the ring member are adhered intimately at a portion of the cutting face.

First, by intimately adhering the skirt portion to the ring member at the portion of the cutting face, the skirt portion of the cap proper at least in the closed state is circumferentially bundled and fixed by the ring member so that the skirt portion is prevented from broadening outwardly and accurate sealability against the mouth portion of the container is maintained. This feature is especially important in the case of the cap of the present invention which is provided with axially extending slits in the skirt portion. The slits at the skirt portion act so as to weaken the engaging state between the mouth portion of the container and the protrusions of the skirt portion, but as a result of the action of circumferentially bundling and fixing by the ring member, the engaging state becomes firm and accurate.

Since a plurality of frangible bridges or connecting portions for linking the skirt portion of the cap proper to the ring member on an upper side or a lower side than the cutting face, the provision of the cutting surface is prevented from adversely affecting the bridge portions or connecting portions. At the time of closing the cap, since the outer surface of the skirt portion of the cap proper and the inner surface of the ring member are intimately adhered to each other, the action of an outer force on the bridge portions which are frangible is prevented so that the protection of bridge portions at the time of closing the cap is advantageously achieved.

Since in the present invention an opening tab is formed in a part of the ring member, divergence occurs between the ring member and the skirt portion at the cutting face by pushing up or down the tab whereby the bridge portion connecting the cap proper with the ring member is cut off by a shearing force. Because slits are formed in the skirt portion of the cap proper, when the ring member is removed from the skirt portion, the skirt portion is freely broadened diametrically outwardly. Thus, the cap proper is easily eliminated from the mouth portion of the container and can be opened easily without using a tool.

By forming a plurality of ribs in an outer surface of the opening tab, the strength of the opening tab is reinforced, or its position can be clearly shown.

When the opening of the cap has already been performed, the bridge portion is broken, and the ring member can be moved up and down. It is thus known that the cap is already opened. This further imparts tamper-evident characteristics.

Since in the present invention the skirt portion of the cap proper and the ring member are formed by integral injection or compression molding, forming slits by a cutter between both to separate a portion excepting the bridge portions or further connecting portions, they can be produced by using a mold composed usually of a core and a cavity, and a molding procedure is easy.

Between the skirt portion of the cap proper and the ring member, only the frangible bridge portions may be formed, whereby the cap proper may be separated from the ring member in opening the cap. In this case, as a result of cutting off the ring member, tamper-evident characteristics become more marked. Furthermore, when the ring member is cut off, the lower end of the skirt portion is pushed up by a finger whereby by the existence of slits, the cap proper can be easily opened.

On the other side of the tab, connecting portions for connecting both may be positioned between the skirt portion of the cap proper and the ring member, and in opening the cap, the bridge portions are broken by pushing up or down the tab. Thereafter, by lifting the ring member, the engagement between the skirt portion of the cap proper and the mouth portion of the container can be released. In this case, the advantage is that the ring member can be utilized as an opening handle of the cap proper.

An inner ring which is engaged with the inner circumferential side of the mouth portion of the container may be formed in the top panel portion. In this case, sealing may be performed at the inner circumferential side of the mouth portion of the container, and the sealing advantageously becomes more accurate.

In the cap of this invention, the lower end of the ring member may be positioned below the lower end of the skirt portion of the cap proper. By so doing, the lower end of the skirt portion of the cap proper is hidden by the ring member. When a cap is opened by inserting an instrument into the lower end of the skirt portion, the bridge portions necessary break. Therefore, tamper-evident characteristics can be increased.

Furthermore, the lower end of the ring member and the lower end of the skirt portion of the cap proper may be provided so that they are positioned on the same horizontal plane. In this case, when empty caps are loaded, a load, etc. is added to the bridge portions to prevent breakage.

Furthermore, a weakened portion, such as a cut, can be formed to display cap opening at a lower part of the ring member in a direction of about 90° C. with respect to the tab of the ring member. By this cut formation, when an opening tab is pushed upwardly to open the cap, since the ring member is bended and broken from the weakened portion, the display of cap opening becomes more clear. When opening by means of an instrument is forcibly carried out from the opposite side of the opening tab, that is to say, from the connecting portion, the weakening portion is bended and broken, it can be leaned that the opening is unfairly carried out.

Furthermore, in the upper portion or the lower portion of the connecting portions, partial weakened portions may be formed. When a tool is inserted into the connecting portions to perform unfair opening, the ring member is opened outwardly, and the engagement of the tool is released. Thus, tamper-evident characteristics increase.

In order to increase tamper-evident characteristics, the top panel portion of the connecting portion side may be provided with partial weakened portions. When an unfair opening of the cap by the tool is carried out from the connecting portion side, the top panel portion of the cap is cracked, and one can learn the performance of an unfair opening.

In the cap of this invention, the inner ring can have an inclined end edge so that the inner ring is relatively long on the tab side, and relatively short on the connecting portion side. As already stated, the opening of the cap proper can be performed by lifting the ring member from the side of the connecting portions. At the time of opening from the side of the connecting portions, a gas vent from the short inner ring is effectively carried out to effectively prevent blowing of contents, namely blow off.

The above prevention of blow off is also effectively carried out by providing weakened portions on the inner surface of the inner ring on the side of the connecting portions. This makes the deformation of the inner ring on the side of the connecting portions easy, and the release of the gas inside the container is carried out effectively via the inner ring.

Furthermore, a gas-barrier material can be insert-molded in the top panel portion of the inner surface of the inner ring. This makes it possible to prevent the permeation of gas through a plastic cap wall, and the preservability of contents can be increased.

Furthermore, in the cap of the present invention, a total circumferential ring or intermittent rings which project upwardly into an outer circumferential portion of the top panel portion may be formed, whereby it can be prevented from causing the trouble when the containers with the cap are loaded with each other. When the contained solution is a carbonated beverage, doming occurs on the top panel of the cap. Accordingly, when such containers are loaded, the top panel portion which has been domed is pressed, and the engagement protrusion of the skirt portion is broadened and the sealing reliability is decreased, and as a result of forming the above ring, such an inconvenience can be prevented.

DETAILED DESCRIPTION OF THE PREFERRED EMBODIMENT

The present invention will now be described in detail with reference to the accompanying drawings.

Figure 1:
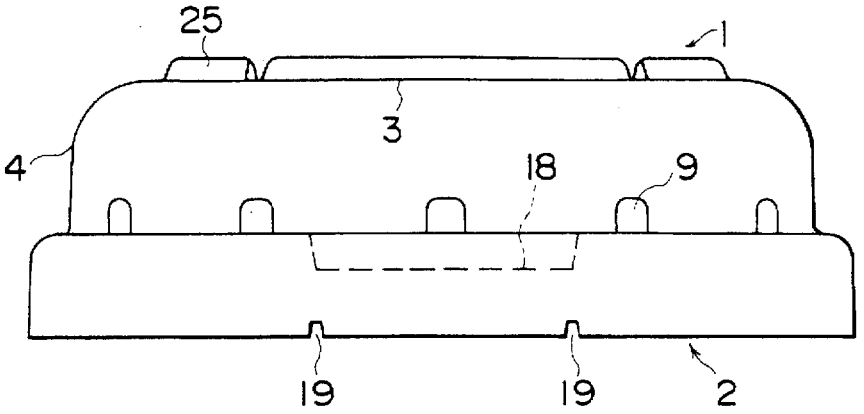
FIG. 1 is a side view showing one example of the cap of the present invention.
Figure 2:
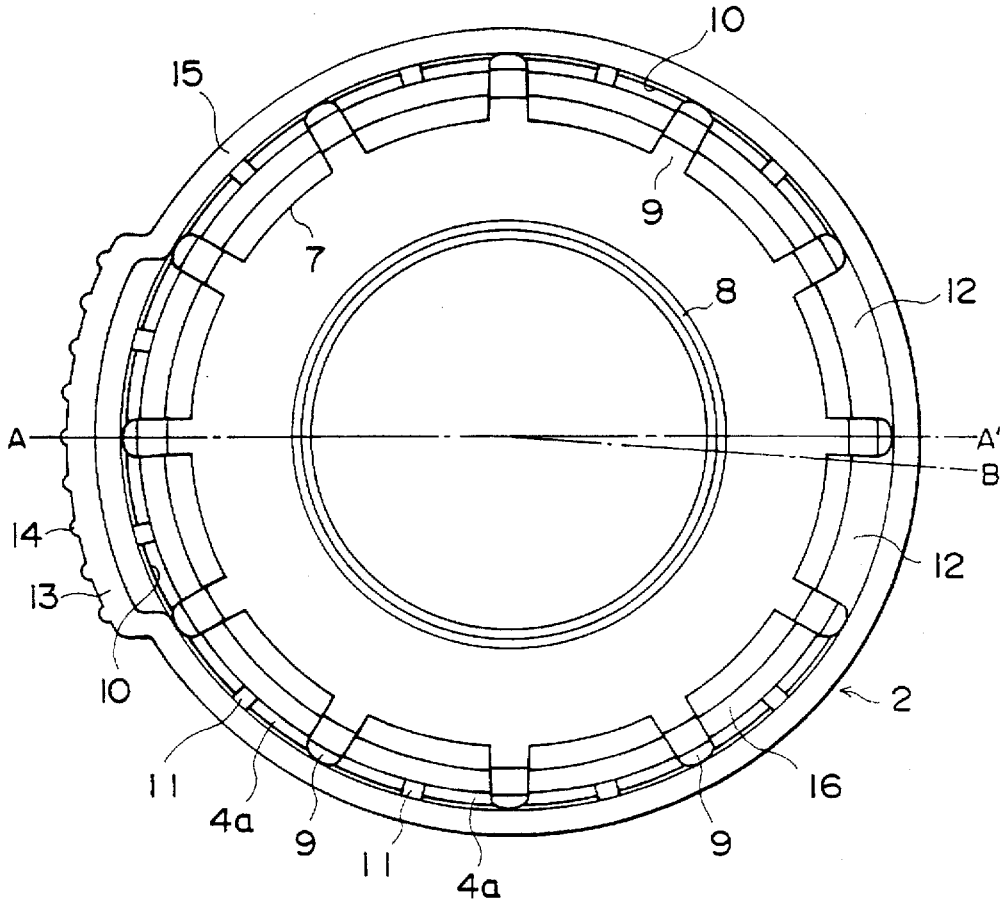
FIG. 2 is a bottom view of the cap of FIG. 1.
Figure 3:
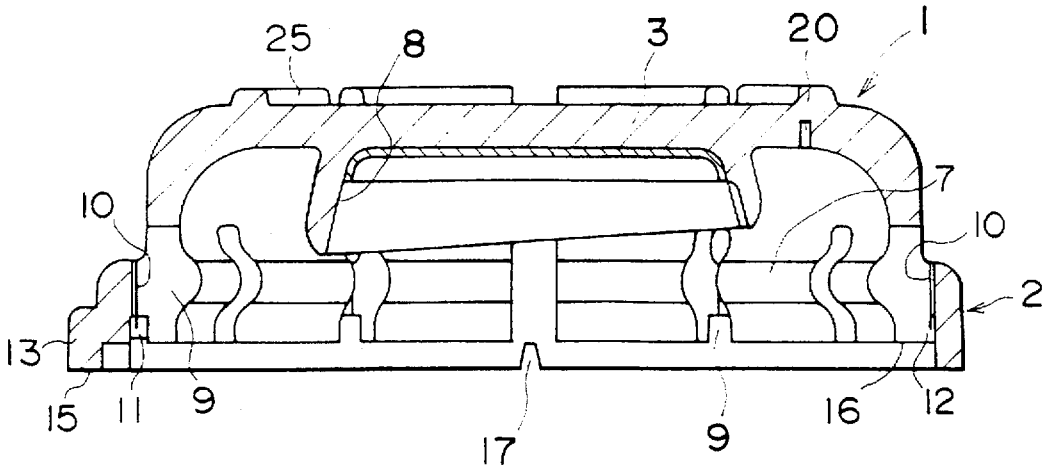
FIG. 3 is a sectional view taken along line A–A' of FIG. 2.

In the side view (FIG. 1) showing one example of the cap of this invention, the bottom view (FIG. 2), the A–A' sectional view of FIG. 2 (FIG. 3), the sectional view (FIG. 4) shown by A–B section in a condition in which the cap is mounted on the mouth portion of the container, and the upper surface view (FIG. 5), the cap of this invention, roughly speaking, consists of a cap proper 1 and ring member 2. The cap proper 1 is composed of a top panel portion 3 and a skirt portion 4 suspending from the outer circumference of the panel 3.

Figure 4:
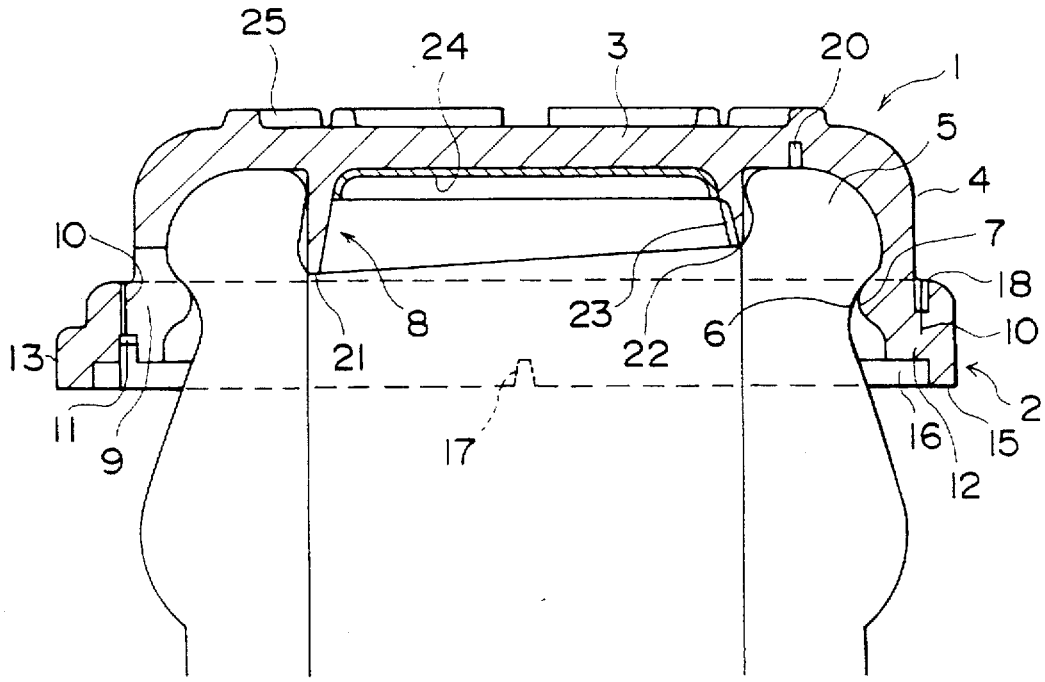
FIG. 4 is a sectional view taken on line A–B of FIG. 2 in a condition in which the cap is mounted on the mouth portion of the container.

As is best shown in FIG. 4, protrusions 7 which are engaged with concave portions 6 on the outer circumferential side of the mouth portion 5 of the container are formed in the inner circumference of the skirt portion 4 so that the mouth portion 5 of the container is intimately adhered to the inside surface of the top panel portion 3 to perform sealing. Furthermore, in this specific example, the top panel portion 3 has formed therein an inner ring 8 to be engaged with the inner circumferential side of the mouth portion 5 of the container whereby sealing is carried out in the inner circumferential side of the mouth portion 5 of the container to make the sealing more accurate.

The ring member 2 is not divided and it is provided so as to cover at least a part of the outer surface of the skirt portion 4 in the form of a continuous ring. The skirt portion 4 of the cap proper 1 covered with the ring members 2 is provided with a plurality of slits or cuts 9 extending in an axial direction at intervals in a circumferential direction. The skirt portion 4 of the cap proper 1 and the ring member 2 are separated via the cutting face 10, and the skirt portion 4 and the ring member 2 are integrally formed via a plurality of frangible bridge portions 11 and unbreakable connecting portions (hinge) 12 which are below the cutting face 10. The outer surface of the skirt portion 4 of the cap proper and the inner surface of the ring member 2 are intimately adhered to each other at a portion of the cutting face 10 in a condition in which the cap proper 1 is applied to the mouth portion 5 of the container (FIG. 4).

Figure 5:
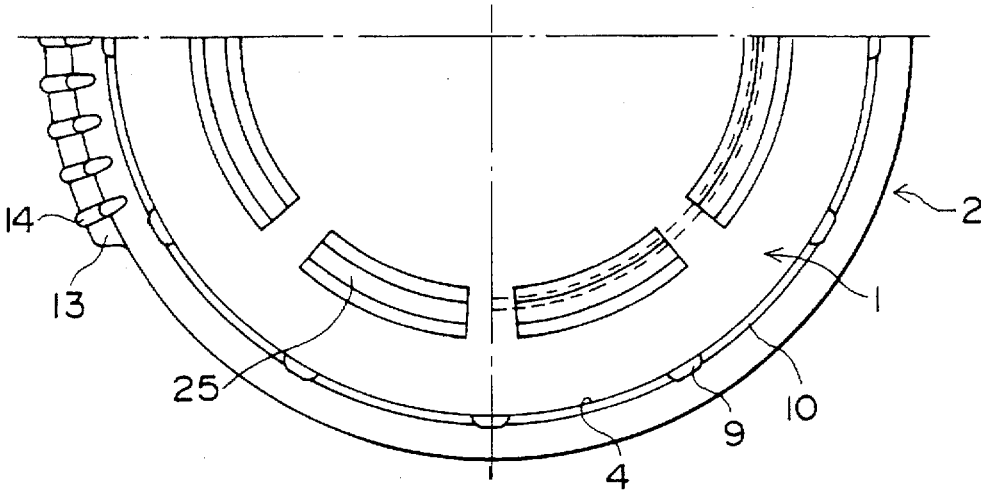
FIG. 5 is an upper view of the cap of FIG. 4.

An opening tab 13 protruding diametrically outwardly is formed at a part of the ring member 2, and in opening the cap, the tab is held so that the ring member 2 may be pushed up or down. As shown in FIG. 5, a rib 14 extending diametrically is formed in the opening tab 13 to reinforce the opening tab 13 or display its position.

The plurality of axially extending cuts 9 provided in the skirt portion 4 of the cap proper 1, in a cap opening condition (in which the ring member 2 is removed), make it possible for the skirt portion 4 to broaden diametrically outwardly, whereby the engagement between the concave portion 6 of the outer circumference of the mouth portion of the container and the inwardly directed protrusion 7 of the skirt portion is released and the elimination of the cap proper 1 from the mouth portion 5 of the container can be easily carried out. The number of cuts 9 provided or the transverse gaps of these cuts may be properly determined.

In the cap of the present invention, the number of cuts 9 provided in the skirt portion 4 may differ depending upon the diameter of the cap, but it is preferably 2 to 20, especially 8 to 12.

By adhering the skirt portion 4 and the ring member 2 intimately at a portion of the cutting face 10, the skirt portion 4 of the cap proper is circumferentially bundled and fixed at least in a cap closed condition with the ring member 2 whereby the skirt portion 4 is prevented from broadening outwardly, and accurate sealing with respect to the mouth portion of the container can be maintained. In the cap of this invention in which the cuts 9 extending in an axial direction are provided in the skirt portion 4, this intimate adhering condition is particularly important. The cuts 9 in the skirt portion 4 act to weaken the condition of engagement between the concave portion 6 of the outer circumference of the mouth portion of the container and the protrusion 7 of the skirt portion 4. But when the force of bundling and fixing acts by the ring member 2, the engagement condition becomes firm and accurate.

Since the plurality of frangible bridges 11 or the linking portions 12 are provided for linking the skirt portion 4 of the cap proper and the ring member 2 below the cutting face 10, the engraving of the cutting face 10 is prevented from adversely affecting the bridge portions 11 or the connecting portions 12. Because at the time of closing the cap the outer surface of the skirt portion 4 of the cap proper is adhered intimately to the inner surface of the ring member 2 at a portion of the cutting face 10, an outer force is prevented from acting on the breakable bridge portions 11, and the protection of the bridge portions 11 is perfect at the time of closing the cap.

In the present invention, the intimate adhering condition of the skirt portion 4 of the cap proper and the ring member 2 via the cutting face and the formation of the bridge portions 11 and the connecting portions 12 may be carried out by integrally injection molding or compression molding both, thereafter forming a cut between both by means of a cutter to separate a portion excluding the bridge portions 11 and the connecting portions 12. Therefore the cap of the present invention can be produced with good efficiency and within a short period of time by usually using a mold composed of a core and a cavity, an advantage may be obtained in that the accuracy of each part of the cap is high, and the occurrence of poor goods is small.

The number of the bridge portions 11 provided between the skirt portion 4 of the cap proper and the ring member 2 is such that the skirt piece 4*a* between adjoining cuts 9, 9 and the ring member 2 is connected via at least one bridge portion 11. The position of providing the bridge portion 11 may be variously provided. For example, as shown in FIG. 2, one bridge portion may be provided in a skirt piece 4*a*, or two bridge portions may be provided on both ends of the skirt piece 4*a*. The position and the number are not particularly limited so long as at the time of closing the cap, the breakage of the bridge portions is prevented and at the time of opening the cap, the bridge portions can be easily broken. The cross-sectional area of the bridge portion 11 in its direction of the cutting face 10 of the bridge portion 11 is preferably 0.1to 0.8 $mm^2$, especially 0.2to 0.4 $mm^2$, per one bridge portion.

An opening tab 13 protruding diametrically outwardly is formed at a part of the ring member 2. This opening tab 13 is positioned in an opposite direction (180° direction) with respect to the connecting portion 12. By pushing up or down the opening tab 13, a divergence occurs between the ring member and the skirt portion at the cutting face, and the bridge portion 11 linking the cap proper 1 and the ring member 2 is cut off under a shearing force.

Figure 6:
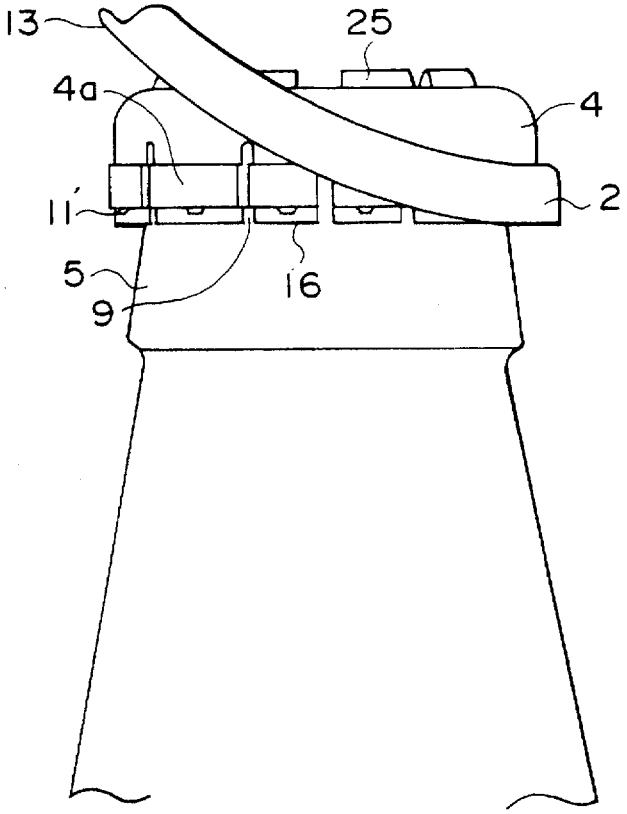
FIG. 6 is an explanatory view showing the opened state of the cap of FIG. 4.

FIG. 6 shows the state of lifting the ring member 2. Since the cutting face 9 is provided in the skirt portion 4 of the cap proper, when the ring member 2 is removed from the skirt portion 4, the broadening of the skirt piece 4*a*in a diametrically outward direction becomes free and the cap proper 1 can be easily eliminated from the mouth portion 5 of the container. Hence, the container can be easily opened without using any particular tool. Since in FIG. 6 the ring member 2 is fixed to the cap proper 1 at the connecting portion 12, and is lifted upwardly as a gripping tool, the bridging portion 12 becomes a fulcrum and the cap proper 1 can be easily removed.

When the cap has already been opened, the bridging portions 11 have already been broken and the ring members 2 can be freely moved up or down. From this state, one can already learn that the cap has already been opened. By breakage and bending at the weakening portion 17, it is learned that the cap is already opened, and therefore tamper-evident characteristics are given.

Various mechanisms preventing from opening unfairly cap and mechanisms for showing that unfair cap opening is carried out can be provided in the cap of this invention. Some of these mechanisms are shown in FIG. 4.

In the cap shown in the specific example of FIG. 4, the lower end 15 of the ring member 2 is positioned below the lower end 16 of the skirt portion 4 of the cap proper. By so doing, the lower end 16 of the skirt portion of the cap proper is hidden by the ring member 2, and therefore, when an attempt is made to open the cap by inserting an instrument into the lower end 16 of the skirt portion, the bridge portions 11 are broken, and the fact of opening the cap can be known and tamper-evident characteristics can be increased. The lower end 15 of the ring member 2 suitably extends downwardly over about 0.8 to 1.2 mm below the lower end 16 of the skirt portion.

It is possible to form a weakened portion for displaying cap opening, such as a cut 17, in a lower portion of the ring member in a direction of about 90° with respect to the opening tab 13 of the ring member 2. When an opening tab is pushed upwardly to open the cap, the breakage and bending occur at the weakening potion 17 (this deformation is a plastic deformation). Even if this is returned to the original, the fact of cap opening can be known, and tamper-evident characteristics can be increased more. Thus, when cap opening by a tool from the opposite side of the opening tab, namely, the side of the connecting portion 12, is forcibly carried out, the weakened portion 17 breaks, and one learns that the cap opening is performed unfairly.

Furthermore, a partly weakened portion, namely a groove 18, may be formed on the upper portion of the connecting portion 12, or a weakened portion, namely a cut 19, may be formed in both ends of a lower portion of the connecting portion 12. When an attempt is made to open the cap unfairly by inserting a tool in the connecting portion, the ring member is opened outwardly, the engagement of the tool is liable to be released, and the tamper-evident characteristics can be increased.

In order to increase the tamper-evident characteristics, a partial weakened portion 20 may be formed in the top panel portion 3 on the side of the connecting portion 12. Therefore, when an unfair opening of the cap is carried out by using a tool from the side of the connecting portion 12, the top panel portion 3 of the cap is deformed or broken, and one can learn that the cap has been unfairly opened.

In the cap of the specific example shown in FIG. 4, an inner ring 8 is formed to have an inclined end edge so that the inner ring 8 is relatively long on the side of an opening tab 21, and is relatively short on the side of a connecting portion 22. As already stated before, the opening of the cap proper is carried out from the side of the connecting portion 12 by lifting the ring member 2. In the cap opening from the side of the connecting portion 12, the venting of a gas from the shorter inner ring 22 is carried out effectively, and the blowing of the contents, that is to say the blowing off, can be prevented effectively.

The above-mentioned prevention of blow off can be effectively carried out by providing a weakened portion 23 on the inner surface of the inner ring 22 on the side of the connecting portion. This makes it easy to transform the inner ring 22 on the side of the connecting portion, and the gas inside the container is effectively released via the inner ring 22.

Furthermore, a gas-barrier material 24 may be provided by insert molding in the top panel portion of the inside surface of the inner ring 8. This makes it possible to prevent permeation of the gas through the plastic cap wall and to increase the preservability of the contents. Examples of the gas-barrier material include, for example, metal foils such as aluminum foil, and a gas-barrier resin such as an ethylene/vinyl alcohol copolymer, a vinyl chloride resin, a vinylidene chloride resin, nylon resin, and gas-barrier polyesters.

In place of the gas-barrier material or in combination with the gas-barrier material, an oxygen absorbing layer may be provided in the top panel portion. As the oxygen absorbing layer, iron-type oxygen absorbing agents, for example, dispersed in a resin may be used.

In the cap of the specific example shown in FIG. 4, a total circumferential or intermittent ring 25 may be formed which protrudes upwardly into an outer cylindrical portion of the top panel portion 3. By this action, the inconvenience of loading the containers with each other in which the cap is provided can be effectively prevented. When the contained product is a carbonated beverage, the top panel of the cap which is domed is pressed when the containers are loaded and the engaging protrusions 7 of the skirt portion is proadened diametrically outwardly to reduce sealability, but the formation of the ring 25 can prevent such an inconvenience.

In the caps shown in FIGS. 1 to 5, the upper portion of the cut 9 is exposed to an outside portion as best shown in FIG. 1. The caps of these examples are advantageous in that the contents adhering to the outer circumference of the mouth portion at the time of filling the contents can be washed and removed through the cuts 9.

Figure 7:
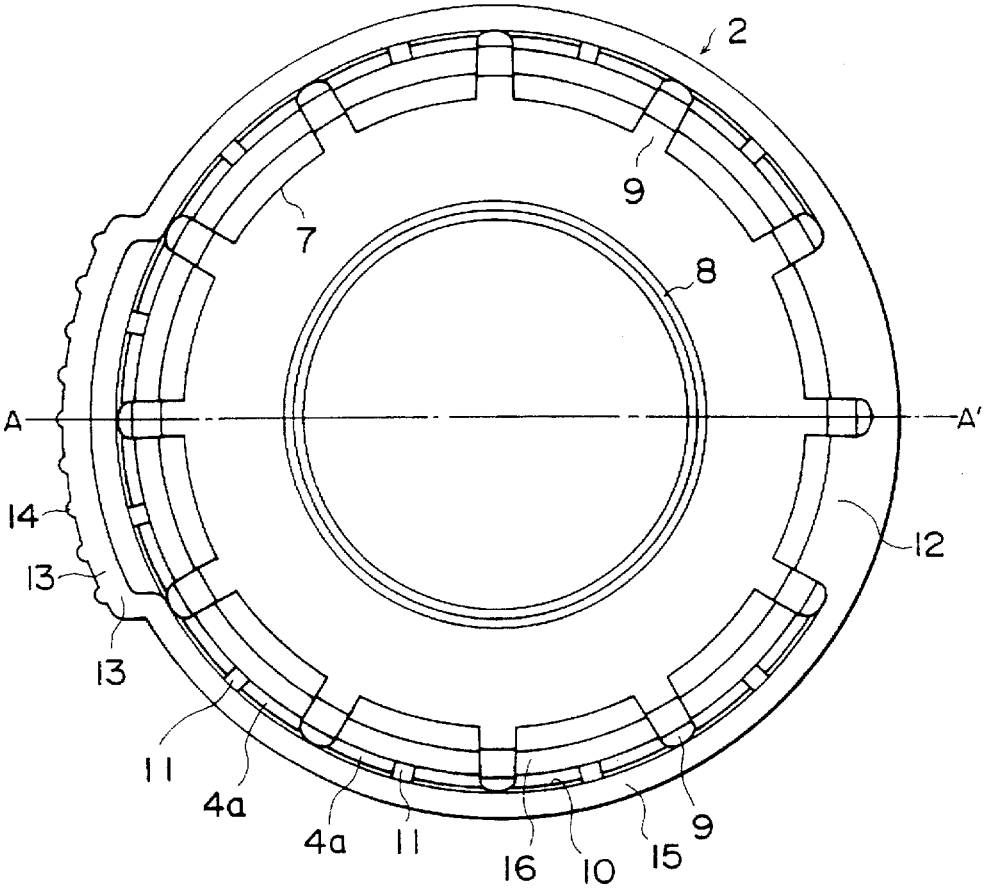
FIG. 7 is a bottom view of the cap of still another example when the under surface is the same horizontal plane.
Figure 8:
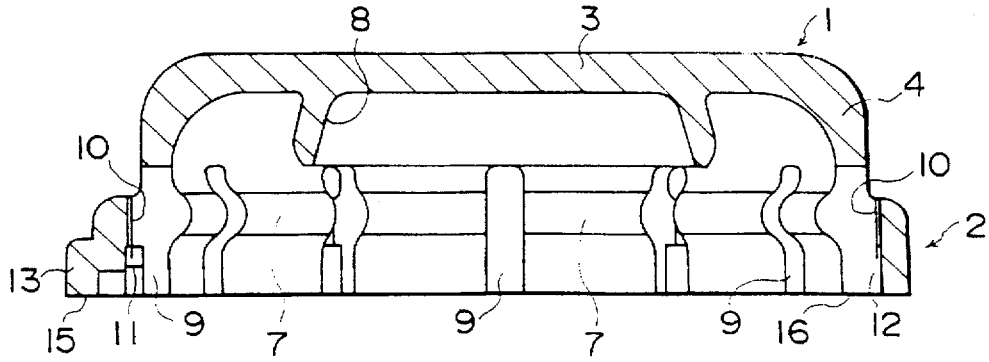
FIG. 8 is a sectional view taken along line A–A' in FIG. 7.

In the cap of the bottom view (FIG. 7) and the cap of the sectional view of line A–A' (FIG. 8) in FIG. 7 in other examples, the lower end 15 of the ring member 2 and the lower end 16 of the skirt portion 4 of the cap proper may be provided so as to be positioned on the same horizontal plane. In this case, it is possible to prevent effectively the addition of a load on the bridge portion 11 at the time of loading caps and the consequent breakage of the bridge portion 11.

Figure 9:
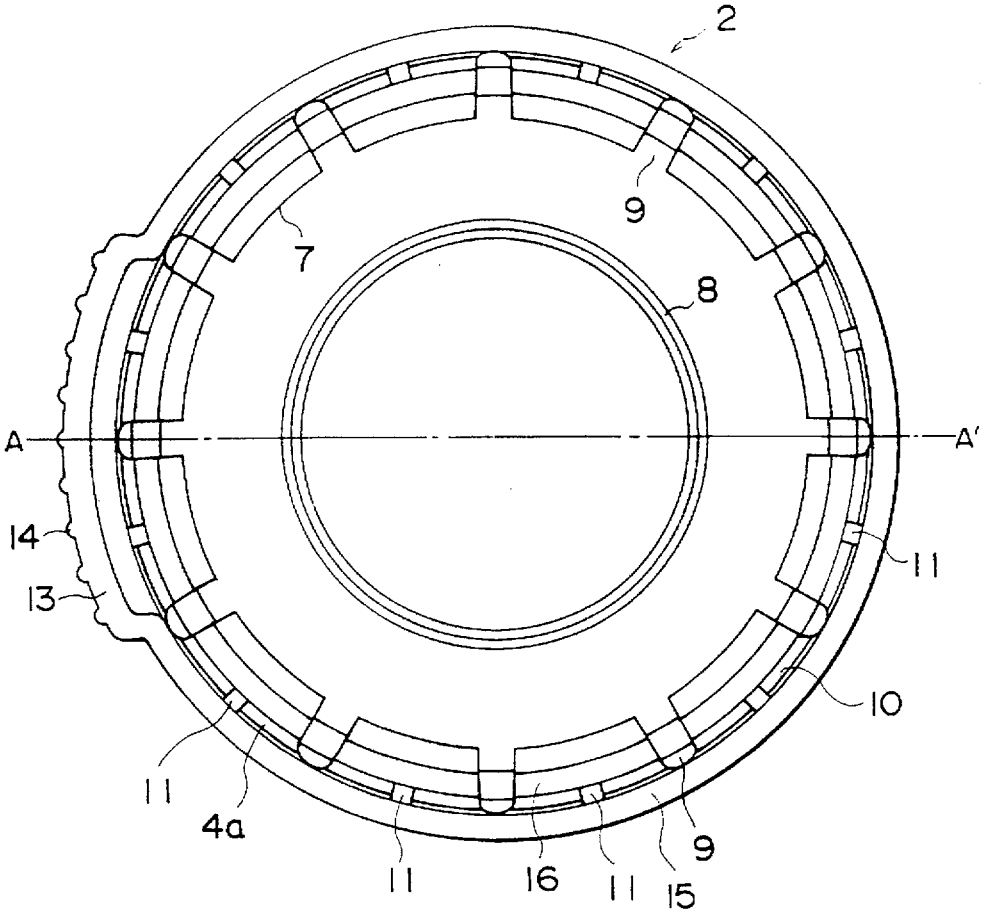
FIG. 9 is a bottom view of the cap of another Example not provided with a connecting portion.
Figure 10:
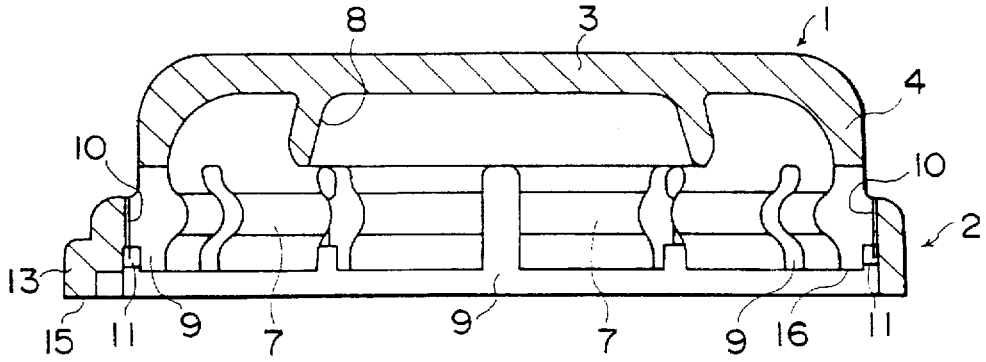
FIG. 10 is a sectional view taken along line A–A' in FIG. 9.

In the caps of the bottom view (FIG. 9) and the sectional view along line A–A'(FIG. 10) in FIG. 9 of other examples, only the frangible bridge portion 11 is formed between the skirt portion 4 of the cap proper and the ring member 2, and on the opposite side of the opening tab 13, the connecting portion 12 is not formed. In opening the cap, the cap proper 1 and the ring member 2 are cut off and separated from each other. In this case, the ring member 2 is cut off, and the tamper-evident characteristics become more marked. Furthermore, even when the ring member 2 is cut off, the lower end 16 is pushed upwardly by a finger, the existence of the cut or slit 9 can easily open the cap proper.

When the skirt portion 4 is connected to the ring member 2 by only the breakable bringe portion 11 alone, the opening tab is not limited to one piece, but two tabs may be provided in a symmetrical position. Furthermore, more than two tabs may be provided.

Figure 11:
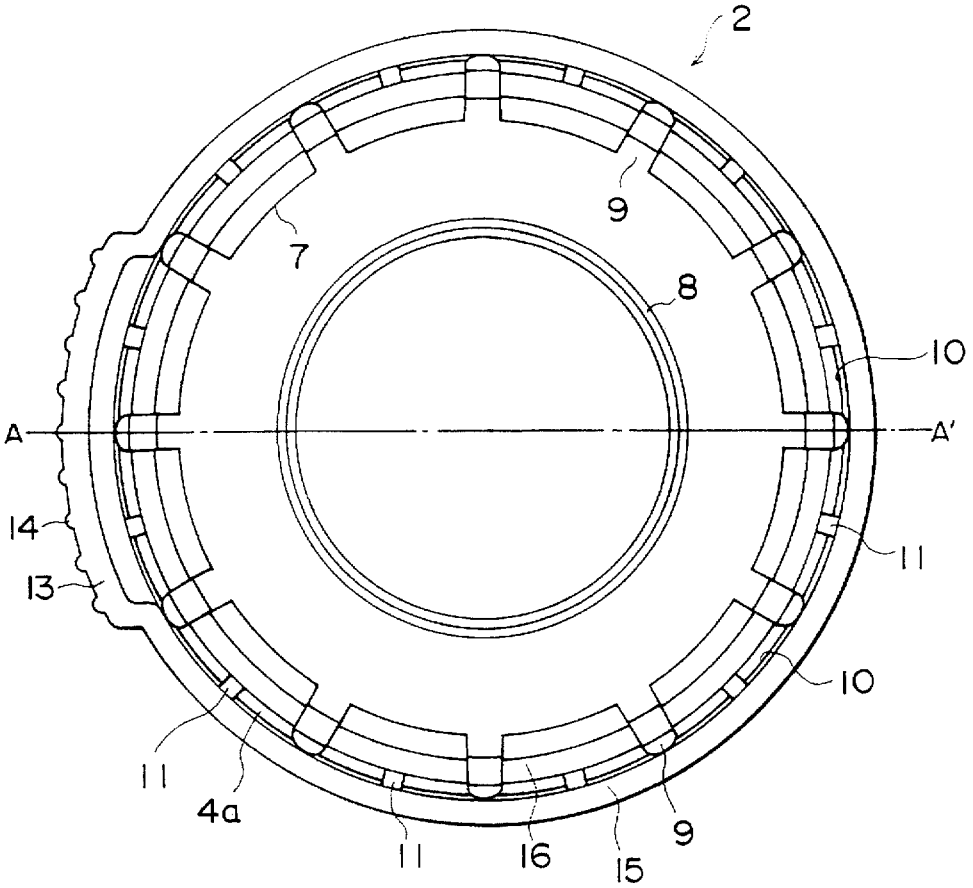
FIG. 11 is a bottom view of the cap of another Example not provided with a connecting portion using the lower surface as the same horizontal plane.
Figure 12:
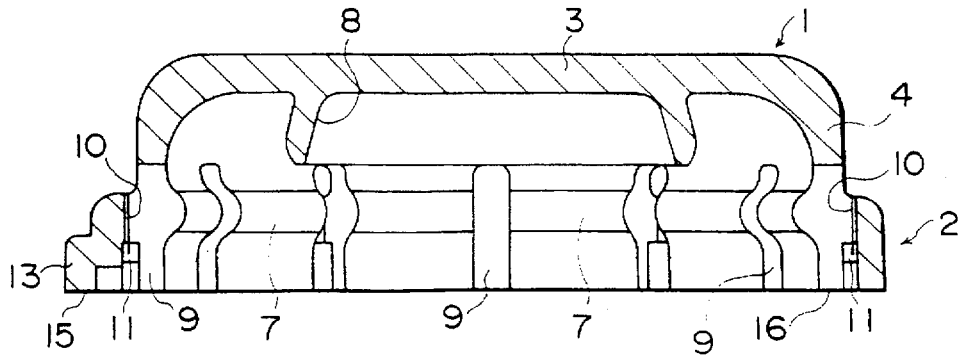
FIG. 12 is a sectional view taken along line A–A' in FIG. 11.

In the caps of examples shown in the bottom view of FIG. 11 and the sectional view of FIG. 12, the lower end 16 of the skirt portion 4 of the cap proper and the lower end 15 of the ring member 2 are provided so that they are positioned on the same horizontal plane. Except that they are the same as in FIGS. 9 and 10.

Figure 13:
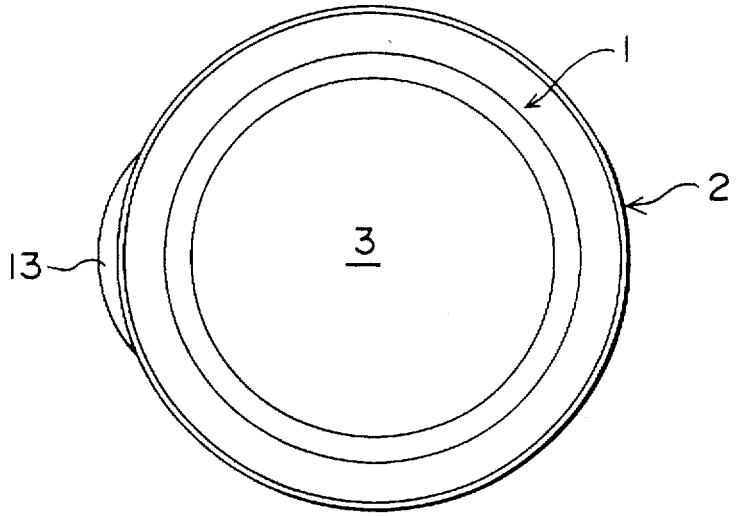
FIG. 13 is an upper surface view showing an example in which cuts are provided so as not to expose into the outer circumference of the skirt portion.
Figure 14:
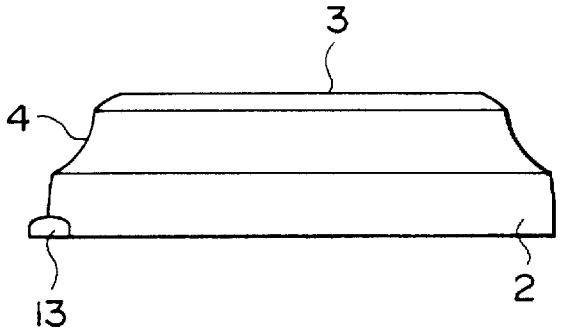
FIG. 14 is a front view of the cap of FIG. 13.
Figure 15:
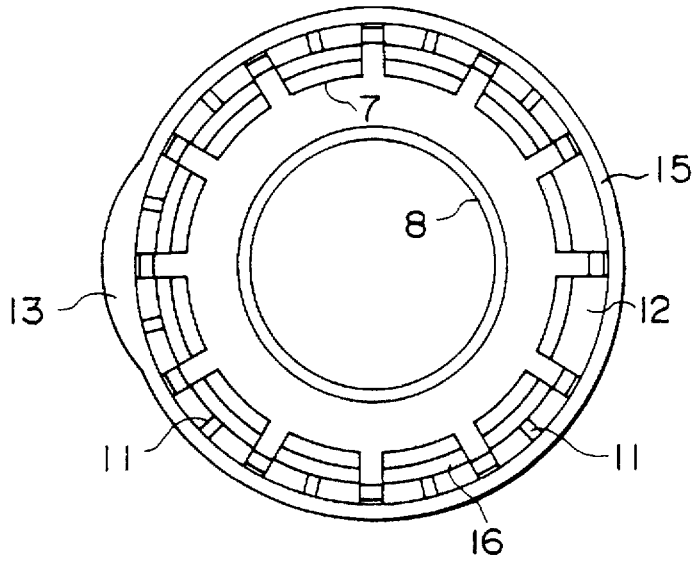
FIG. 15 is a bottom view of the cap of FIG. 13.
Figure 16:
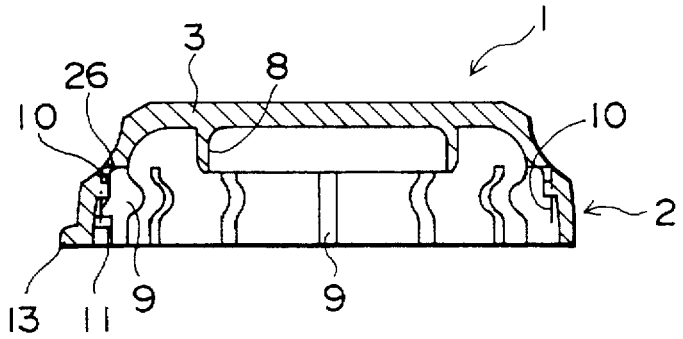
FIG. 16 is a sectional view of the cap of FIG. 13.
Figure 17:
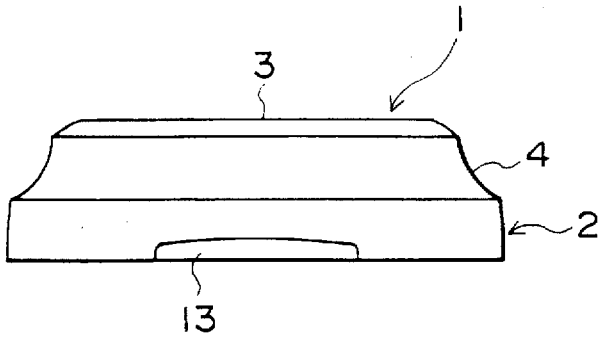
FIG. 17 is a left side view of the cap of FIG. 13.

In the present invention, the cuts 9 may be provided so that they are not exposed into the outer circumference of the skirt portion. In the upper surface view (FIG. 13), the front view (FIG. 14), the bottom view (FIG. 15), the sectional view (FIG. 16) and the left side view (FIG. 17) showing these examples, the constructions of the individual parts have been the same as explained hereinabove. But the outer upper portion 26 of the cut 9 are provided so that it does not reach the outer surface of the skirt portion 4, and therefore, the cut 9 is covered completely with the upper surface of the skirt portion. In the cap of this specific example, an advantage is achieved in that dirt is prevented from entering in the cut 9 and the cap is sanitary.

Figure 18:
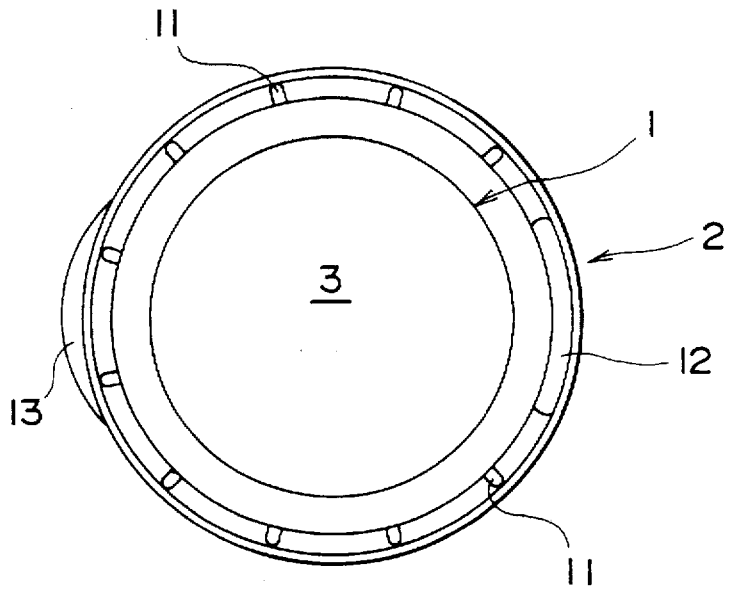
FIG. 18 is an upper surface view showing an example in which bridge portions and connecting portions are provided on the upper side of the cutting face.
Figure 19:
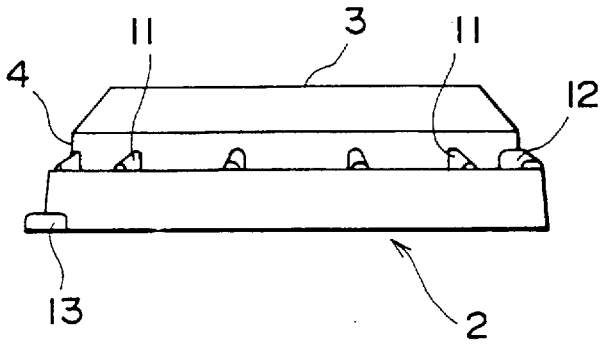
FIG. 19 is a front view of the cap of FIG. 18.
Figure 20:
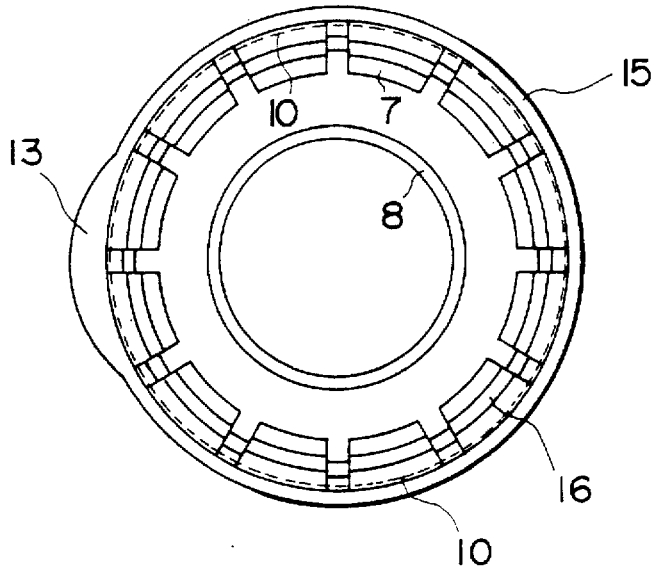
FIG. 20 is an upper surface view of the cap of FIG. 18.
Figure 21:
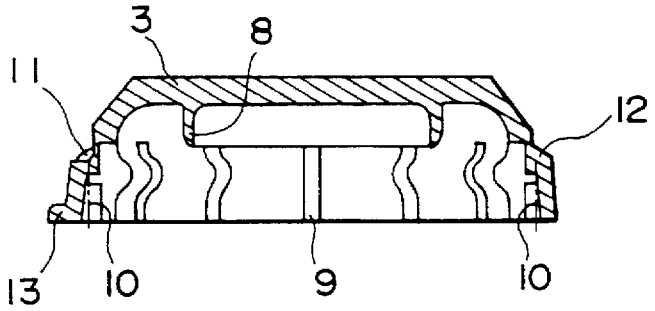
FIG. 21 is a sectional view of the cap of FIG. 18.
Figure 22:
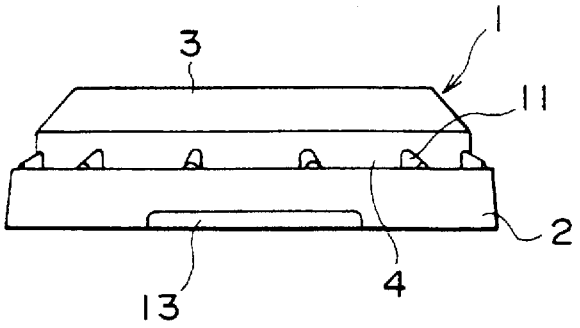
FIG. 22 is a left side view of the cap of FIG. 18.

In the examples explained above, the bridge portion 11 and the connecting portion 12 are provided below the cutting face 10, but in the present invention, the bridge portion and the connecting portion may be provided above the cutting face. In the upper surface view (FIG. 18), the front view (FIG. 19), the bottom view (FIG. 20), the sectional view (FIG. 21) and the left side view (FIG. 22) showing these examples, the constructions of the individual parts are the same as explained hereinabove, but the bridge portion 11 and the connecting portion 12 are formed above the cutting surface 10. In this case, the bridge portion 11 can be seen from outside at a first sight, and it becomes advantageous that the fact of opening becomes clearer.

Examples of the resin used to form the cap are various plastics, such as low-, medium- and high-density polyethylenes, linear low-density polyethylene, polypropylene, thermoplastic polyesters, polyamides, styrene resins, and ABS resin.

The plastic cap of this invention is prepared by using the above resins, and usually integrating the cap proper and ring member by means of injection molding, compression molding, etc. The cutting face is usually produced by applying a cutting processing after the molding step. Of course, a cutting surface can be formed simultaneously with the molding step.

Separately, a liner may be applied to the cap proper. In this case, it is possible to use low-density polyethylene, ethylene copolymers, various rubber or thermoplastic elastomers, acrylic resin plastisol and vinyl chloride resin plastisol.

According to this invention, the above-mentioned constructions make it possible to form a sealing structure having sealing reliability at the time of closing the cap, and to open the cap easily without using any particular tool at the time of cap opening. In addition, this is advantageous that tamper-evident characteristics are imparted. Furthermore, at the time of closing the cap, the ring member protects the skirt portion of the cap proper, in the state of a closure being closed, the ring member adheres intimately to the outer surface of the skirt of the cap proper to maintain sealability, and at the time of opening the cap, the skirt portion can be easily eliminated from the mouth portion of the container as a result of removing the ring member. In addition, it is advantageous that the ring member has tamper-evident characteristics.

What we claim is:

1. A resin cap comprising:

a cap proper which comprises a top panel and a skirt having a protrusion engaging with a mouth of a container at an interface thereof; and a ring member formed integrally with the cap proper so as to cover an outer surface of the skirt;

wherein a plurality of slits elongating in an axial direction are provided in the skirt at an interval into a circumferential direction, the skirt and the ring member are separated by a cutting surface but interconnected with only breakable bridges on an upper side of the cutting surface and an outer surface of the skirt and an inner surface of the ring member are contacted intimately with each other at the cutting surface, and in opening the cap, the cap proper is separated from the ring member.

2. A cap of claim 1 wherein an opening tab is formed in a part of the ring member.

3. A resin cap comprising:

a cap proper which comprises a top panel and a skirt having a protrusion engaging with a mouth of a container at an interface thereof; and a ring member formed integrally with the cap proper so as to cover an outer surface of the skirt;

wherein a plurality of slits elongating in an axial direction are provided in the skirt at an interval into a circumferential direction, the skirt and the ring member are separated by a cutting surface but interconnected with only breakable bridges on an under side of the cutting surface and an outer surface of the skirt and an inner surface of the ring member are contacted intimately with each other at the cutting surface, and in opening the cap, the cap proper is separated from the ring member.

4. A cap of claim 3 wherein an opening tab is formed in a part of the ring member.

5. A resin cap comprising:

a cap proper which comprises a to p panel a skirt having a protrusion engaging with a mouth of a container at an interface thereof;

a ring member formed integrally with the cap proper so as to cover an outer surface of the skirt; and an opening tab formed in a part of the ring member;

wherein a plurality of slits elongating in axial direction are provided in the skirt at an interval into a circumferential direction, the skirt and the ring member are separated by a cutting surface but interconnected with breakable bridges and an unbreakable connecting portion, an outer surface of the skirt and an inner surface of the ring member are contacted intimately with each other at the cutting surface, and a weakened portion for clearly indicating unfair opening is formed in a lower portion of the ring member in a direction of about 90° with respect to the tab of the ring member.

6. A cap of claim 5 wherein the unbreakable connecting portion is positioned on an opposite side of the tab, in opening the cap, the tab is pushed up or down to break the breakable bridges, and then by lifting the ring member, the cap proper is removed from the mouth of the container together with the ring member.

7. A cap of claim 6 wherein a lower end of the ring member is positioned below a lower end of the skirt of the cap proper.

8. A cap of claim 6 wherein a lower end of the ring member and a lower end of the skirt of the cap proper are positioned on the same horizontal plane.

9. A cap of claim 6 wherein a plurality of ribs are formed in an upper surface of the opening tab.

10. A cap of claim 6 wherein the cutting face is formed by cutting a portion between the skirt and the ring member which are obtained by integral-molding.

11. A cap of claim 6 wherein a circumferential ring projecting upwardly is formed in the outer circumferential portion of the top panel.

12. A cap of claim 11 wherein the circumferential ring extends intermittently in the circumferential direction.

13. A cap of claim 6 wherein an inner ring to be engaged with the inner circumferential side of the mouth of the container is formed in the top panel.

14. A cap of claim 13 wherein the inner ring is relatively long on the tab side, and the inner ring is relatively short on the side of unbreakable connecting portion.

15. A cap of claim 13 wherein a barrier material is insert-molded in an inner surface of the top panel inside of the inner ring.

* * * * *